US006425581B1

(12) United States Patent
Barrett

(10) Patent No.: US 6,425,581 B1
(45) Date of Patent: Jul. 30, 2002

(54) MAP PUZZLE GAME

(76) Inventor: Patricia E. Barrett, 20 S. Richfield Rd., Hewitt, NJ (US) 07421

( * ) Notice: Subject to any disclaimer, the term of this patent is extended or adjusted under 35 U.S.C. 154(b) by 0 days.

(21) Appl. No.: 09/714,092

(22) Filed: Nov. 16, 2000

(51) Int. Cl.[7] ..... A63F 3/04

(52) U.S. Cl. ..... 273/157 R; 273/282.1; 434/153

(58) Field of Search ..... 273/157 R, 153 R, 273/273, 282.1; 434/130, 150, 153

(56) References Cited

U.S. PATENT DOCUMENTS

| | | | | | |
|---|---|---|---|---|---|
| 142,338 | A | * | 9/1873 | Higgins | 273/157 R |
| 266,628 | A | | 10/1882 | Hyde | |
| 618,114 | A | | 1/1899 | Mayer | |
| 952,997 | A | | 3/1910 | Sanderson | |
| 1,375,308 | A | | 4/1921 | Mathes | |
| 1,597,562 | A | * | 8/1926 | Allen | 273/273 |
| 2,008,189 | A | * | 7/1935 | Rippon | 273/273 |
| 2,199,499 | A | | 5/1940 | Kreitler | |
| D170,753 | S | | 11/1953 | Fukal | |
| 3,242,591 | A | | 3/1966 | Adams | |
| 3,495,833 | A | | 2/1970 | Wesley | 273/157 R |
| 3,767,203 | A | | 10/1973 | Eaker | 273/157 R |
| 3,942,800 | A | * | 3/1976 | Holbrook | 273/157 R |
| 4,654,988 | A | | 4/1987 | Ericksen | 40/124.1 |
| 4,937,181 | A | | 6/1990 | Rogers | 434/150 |
| 5,009,430 | A | * | 4/1991 | Yuhasz | 273/157 R |
| 5,123,846 | A | | 6/1992 | Lewis | 434/130 |
| 5,147,043 | A | | 9/1992 | Gould | 206/457 |
| 5,259,763 | A | | 11/1993 | Wendel et al. | 434/150 |
| 5,800,182 | A | | 9/1998 | Carson et al. | 434/430 |
| 5,979,752 | A | * | 11/1999 | Holloway | 273/282.1 |
| 5,988,366 | A | | 11/1999 | Krull et al. | 206/8 |

* cited by examiner

*Primary Examiner*—Steven Wong
(74) *Attorney, Agent, or Firm*—Ernest D. Buff & Associates, LLC; Ernest D. Buff

(57) ABSTRACT

An educational map puzzle game teaches children and adults to locate political entities of the world on a map. Puzzle pieces comprised of postage stamp reproductions or simulated postage stamp reproductions correspond to specific sites on large-format continental and regional outline maps. Players earn points for matching puzzle pieces with correct map sites within a predetermined time period. Learning value is enhanced by reference material relating the significance of each postage stamp image to the country or territory it represents. Self-adhesive hook-and-loop members removably attach game pieces to the base. The game can be played on a vertical or horizontal surface. The base is attractive enough to be framed and vertically suspended, or pasted directly to a wall and used interactively with the puzzle pieces. In an alternate embodiment, the map base serves as an ornamental display device for stamp and coin exhibitors and collectors.

30 Claims, 9 Drawing Sheets

Fig. 4c

56

ALPHA KEY—AFRICA world peas™

57 20. Algeria: Famous buildings: The Dey's Palace, Algiers 59

58 30. Algeria: Goat and Tassili Mountains

19. Algeria: Tuaregs in Native Costume

24. Angola: Diquiche Mask

Fig. 4d

60

NUMERIC KEY—AFRICA world peas™

61 1. Mauritania: Preservation of Ancient Cities-Tichitt 63

2. Cape Verde: Tourism-Mountain Peaks

3. Sierra Leone: Woman tending rice plants 62 4. Cote d'Ivoire: Rural Houses-Baoule aoulo

Fig 4e

64

IDENTIFIER FOR NON-ENGLISH NAMES-AFRICA world peas™

65 ALGERIE-Algeria

CABO VERDE-Cape Verde Islands

ISLAS CANARIAS-Canary Islands (Spain)

LIBYAN ARAB JAMAHIRIYA-Libya

NON-ROMAN ALPHABETS

66 Somalia J.d. soomaaliweed

Fig. 5a

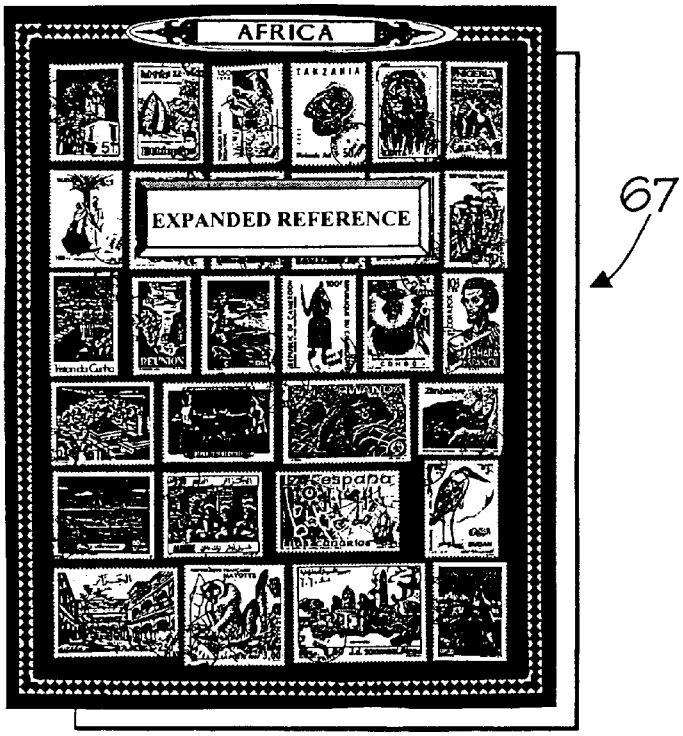

Fig. 5b

EXPANDED REFERENCE—AFRICA 68 70 world peas™ 71

69 (20) Algeria 561 Famous buildings: The Dey's Palace, Algiers

Under the Ottoman Empire the Dey was the absolute ruler over the city of Algiers, until deposed by the French in 1830. The Dey's Palace ("Dar Aziz Bent El Rey Palace"), dates from the 16th century. It is part of the Casbah, one of the finest sites on the Mediterranean coast and the old, upper part of Algiers, with maze-like passageways and a 16th century walled citadel. The architectural style of the Casbah reflects a combination of Turkish military architecture with Moorish and Arab-Mediterranean architectural traditions. The Casbah (including the Dey's Palace) was added to the World Heritage List in 1992.

73 (30) Algeria 723 Goat and Tassili Mountains

The Tassili plateau in the southeastern part of the Algerian Sahara includes the Tassili N'Ajjer National Park, which was added to UNESCO's World Heritage List in 1982. The site is noteworthy for its prehistoric rock paintings, engravings of hippopotamus, buffalo, elephant, rhinoceros and giraffe, and rich archaeological remains from the middle and lower Paleolithic periods. Few species of wildlife remain in the region today because the sparse vegetation will not support diverse animal life. Permanent pastures and meadows still support goats, sheep and cattle.

72

Fig. 6

AFRICA SCORE SHEET 75

(Maximum points: 117)

| NAME OF PLAYER/ TEAM | (x) 3 POINTS | (x) 2 POINTS | (x) 1 POINT | TOTAL SCORE | TIME |
|---|---|---|---|---|---|
| NAME | | | | | |
| NAME | | | | | |
| NAME | | | | | |
| NAME | | | | | |

74

© 2000 world peas

MAP PUZZLE GAME

BACKGROUND OF THE INVENTION

1. Field of the Invention

The present invention relates to teaching aids, and more particularly to a map puzzle game especially suited for teaching geography to children and adults.

2. Description of the Prior Art

Geography is a unifying subject that describes our world. As we watch or read the news, we organize the information we assimilate in many ways. One category always exists—location. Everything happens somewhere. Geography is the subject that relates what we learn to where we are, and provides a frame of reference for learning about subjects such as history, politics, geology, culture, or religion.

A solid grounding in geography is fundamental to understanding today's complex international issues. It is increasingly obvious that our actions in the USA can have profound effects on the rest of the world. Similarly, the impact of decisions made in other parts of the world is felt by Americans. The quality of our lives and that of generations to come depends on geographic sensitivity. Knowing the whereabouts of Serbia, East Timor, Rwanda, Bangladesh and China is prerequisite to understanding global affairs, foreign policy, human rights, world hunger, and international trade. Perhaps most importantly, knowledge of the world's places, peoples and cultures is the starting point for cultivating the kind of global understanding that is a precondition for world peace. Yet, despite the pivotal role of geography in the global context, year after year of national testing continues to show less than satisfying results of student knowledge and understanding of basic geography. The results might well be even more dismal if adults were tested.

The activity of locating countries on a map is oftentimes referred to as "political geography". Learning political geography can be tedious, since students have usually not visited the places they are asked to locate on a map. There is thus no "visual memory" relating abstract shapes on a map to images that help students remember which political entities such abstract shapes represent. Instead, conventional methods for learning political geography rely chiefly on rote memorization, and are fraught with frustration and boredom on the part of students.

Geography teaching aids have utilized various types of fabric charts, learning maps, display devices and other planar panels inscribed with map indicia in combination with a plurality of manipulative elements. Such manipulative elements are said to consist of relational tabs, labels, or cut-apart cards, which are detachably removable with one- or two-member self-adhesive hook-and-loop fasteners. Representative examples of geography teaching aids are disclosed by U.S. Pat. Nos. 4,937,181, 5,259,763 and 5,800,182.

In each of these disclosures, iron velvet or other hook-compatible or Velcro®-compatible fabric is used for a base or background. The hook-compatible fabric obviates the need for separate loop-type fasteners. However, the fabric requires hemming or binding for structural integrity; or requires a rubberized lining and attachment to a rigid or flexible backing. Each of these structures significantly increases the bulk and weight of the fabric. Portability is decreased and the fabric is cumbersome to move or store when not in use. Moreover, the sewing and other labor required substantially raises production costs, thus compromising affordability of the product.

A further shortcoming of hook-compatible fabric is that, when printed with ink indicia, the fabric's hook engagement capacity is diminished throughout the area in which ink indicia are applied. The manipulative elements can fall off the panel, distracting students and hindering implementation of the teaching aid. Moreover, hook-compatible fabric is esthetically unappealing, and projects a decidedly "synthetic" look, feel and smell. Likewise, manipulative elements such as color-coded tabs, printed words, icons and the like, have typically been flimsy. (See, for example, the Fabric Chart Kit referenced by U.S. Pat. No. 5,800,182, the tabs of which must be laminated by end-users to be rendered durable.)

Manipulative elements having the form of postage stamps have not been disclosed or suggested. Fabric chart kits of the conventional type are not recyclable, which is disappointing to environmentally sensitive consumers. Panel indicia and manipulative elements conventionally employed are esthetically and emotionally uninspiring. They fail to captivate the imagination and sustain the attention of participants, or otherwise assist children and adults to retain and apply lessons taught.

Continental map puzzles of the jigsaw variety are known, for example, from "Ravensburger/F.X. Schmid Maps of the World Frame Puzzles." Also known are geography learning toys and games that assist with reinforcement of geographic educational concepts. None of these puzzles, games, or teaching aids suggests use of postage stamp images or reproductions to indelibly relate an abstract shape on a map to something memorable about the political entity such abstract shape represents. Postage stamp images are compelling, distinctive, intrinsically interesting pieces of miniature art, and thus present a unique opportunity to capture the imagination of children and adults alike. These factors have not been recognized by prior art workers; postage stamps have not been suggested for use in geography teaching aids.

US and non-US postage stamp reproductions have been used in fields unrelated to geographic games and teaching aids. U.S. Pat. No. 5,147,043 discloses a stamp collector display card device. The device involves reproductions of U.S. and non-US postage stamps on the front surface of 2½ inch×3½ inch stamp collector cards. No disclosure is contained therein regarding use of stamps as manipulative elements for geography teaching aids or games.

U.S. and non-U.S. postage stamp reproductions have been used in a self-correcting tutor game sold by Educational Insights, Dominguez Hills, Calif., under the trademark Geosafari Learning Game®. This game includes a plurality of twenty-lesson card sets, each set of which includes lessons in a plurality of disciplines, including geography, science, world history, modern languages, ecology, and biology. One of these lesson card sets is entitled "Exploring Stamps," and contains cards imprinted with indicia comprising a plurality of full-color, enlarged or reduced reproductions of non-canceled U.S. and non-U.S. postage stamps. The postage stamp indicia relate to plants, animals, inventions, world geography, and flags of the world. Lesson cards feature questions related to the postage stamp indicia. No attempt is made to relate the images on the postage stamps to places on a map; no use is made of postage stamp images as manipulative elements or playing pieces.

There remains a need in the art for a method and means that facilitates the study of political geography in classroom, home and other environments. Especially needed is an amusing, compelling, and exciting teaching aid that effectively enables students of political geography to retain and apply lessons learned.

SUMMARY OF THE INVENTION

The present invention provides a multidisciplinary geography learning aid that enables both children and adults to learn to locate the world's countries, territories and other political entities on a map in an enjoyable and effective manner. It inspires curiosity about each country's culture, thus helping to facilitate mutual understanding, respect and peace. Game participants also develop heightened awareness concerning the importance of cultural preservation and ecological protection in a rapidly changing world.

Adapted for both classroom and home use, and for children and adults alike, the method and means of the invention features U.S. and non-U.S. postage stamp reproductions as puzzle game pieces. These pieces are appointed for deployment on a relational puzzle base imprinted with an artistic, accurate, large-format outline map of a world continent or region. Self-adhesive hook-and-loop members removably attach the puzzle game pieces comprising stamp reproductions to the map puzzle base. This attachment mechanism enables the puzzle game to be played on either a vertical or horizontal surface. Individual players or teams are challenged to match puzzle pieces with correct map sites within a specified time period, earning points for each correct match.

Learning is enhanced with (i) a concise key illustrating the correct location on the map for positioning each puzzle piece, and (ii) reference material relating the significance of each stamp image reproduced on a puzzle piece to the country or other political entity it represents. The base can be suspended vertically from a wall or bulletin board, with or without a frame, or pasted directly to a wall to form a decorative wall panel and used interactively with the puzzle pieces. Advantageously, the base can alternatively be used by stamp and coin exhibitors and collectors as an ornamental display device for proprietary collections.

More specifically there is provided in accordance with the invention an educational map puzzle game having the following elements: (i) a relational map puzzle base including a large format outline map of a world continent or region with indicia; (ii) puzzle pieces comprising reproductions of postage stamps associated with countries or territories represented on the map; (iii) a concise reference key illustrating the correct positions on the map of each puzzle piece; and (iv) reference material relating the significance of each stamp image reproduced on a puzzle piece to the country or other political entity it represents.

The puzzle pieces are removably attached to the map puzzle base by means of hook-and-loop fasteners such as Velcro®. In a preferred embodiment, the map puzzle base is fabricated from flexible plastic material that is lightweight and easily rolled up to be stored in an original packaging tube. Opposable hook or loop portions of the Velcro® or generic equivalent fasteners are adhered to the areas on the map puzzle base as denoted by specific indicia. The puzzle pieces may depict stamp themes such as plants, animals, historic events, architecture, archaeological sites, famous monuments, and indigenous people in local costumes.

Significant advantages are incorporated into the elements of the present invention. There is provided a geography learning aid wherein postage stamp reproductions are combined with attractive relational outline maps to create an enjoyable and effective means for children and adults to learn to locate the world's countries, territories, and other political entities on a map. Inasmuch as the as postage stamp themes cover a variety of subjects and disciplines there is provided a multidisciplinary approach to teaching geography. The puzzle or game pieces of the teaching aid include stamp themes such as plants, animals, historic events, architecture, archaeological sites, famous monuments, indigenous people in local costumes, religion and the like. Such pieces preferably are formed from full-color, canceled reproductions of officially issued U.S. and non-U.S. postage stamps, made durable by reproducing the stamps directly onto a heavy-gauge, semi-flexible, recyclable plastic substrate, or by reproduction on paper, which is then laminated on both sides with a clear transparent polymer. The substrate for the map puzzle base is readily constructed without hemming, backing or other labor-intensive work. It is lightweight, recyclable and easily rolled and stored or transported in its original packaging tube when not in use. The map base and game pieces are attractive enough to be suitable for framing and displaying as residential or office wall art. Ornamental aspects of the map puzzle game base commend it for use as a display device for world stamp and coin collections.

BRIEF DESCRIPTION OF THE DRAWINGS

The invention will be more fully understood and further advantages will become apparent when reference is had to the following detailed description of the preferred embodiment of the invention and the accompanying drawings, in which:

FIG. 4*c* is a partial view of a "quick reference" map puzzle key containing an alphabetic listing of the political entities represented by each puzzle piece of the present invention;

FIG. 4*d* is a partial view of a "quick reference" map puzzle key containing an ascending numeric listing of the political entities represented by each puzzle piece of the present invention;

FIG. 4*e* is a partial view of a "quick reference" map puzzle key containing a translation into English of non-English language and non-Roman alphabet political entity name indicia reproduced on puzzle pieces of the present invention;

FIG. 5*a* is a perspective view of the cover of an expanded reference guide booklet containing black-and-white reproductions of postage stamps appointed for use as puzzle pieces of the present invention, a description of the significance of stamp images to the pertinent political entity, and miscellaneous historic and geographic information;

FIG. 5*b* is a partial view of a typical entry from an expanded reference guide booklet containing black-and-white reproductions of postage stamps appointed for use as puzzle pieces of the present invention, a description of the significance of stamp images to the pertinent political entity, and miscellaneous historic and geographic information;

FIG. 6 is a schematic representation of a score sheet adapted for use with the map puzzle game;

DETAILED DESCRIPTION OF THE INVENTION

Figure 1A:
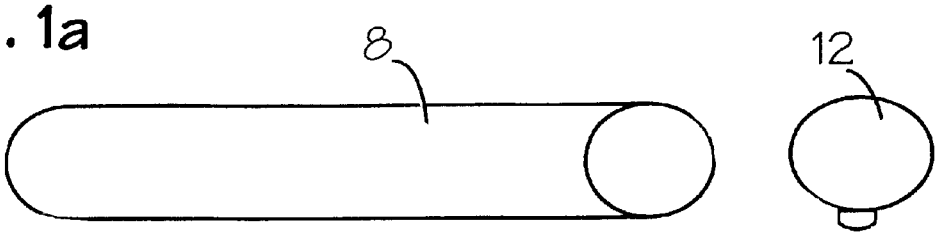
FIG. 1*a* is a side view of a container for storage of map puzzle game components.
Figure 1B:
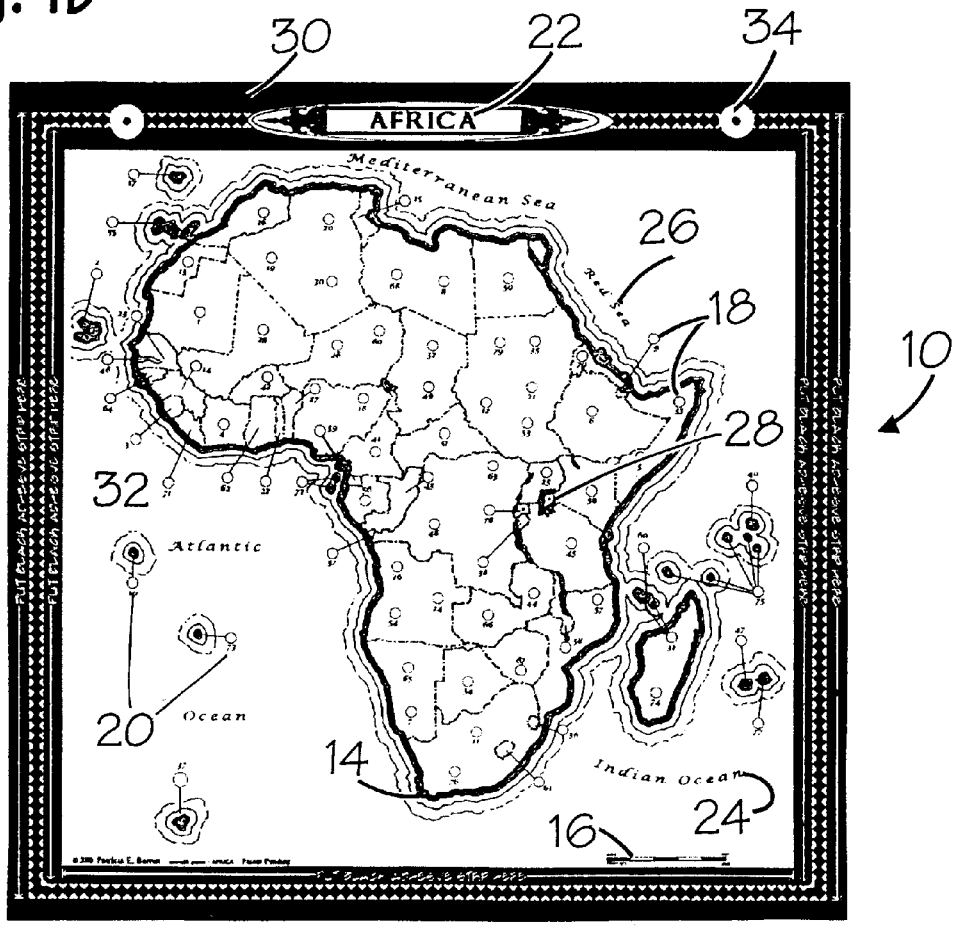
FIG. 1*b* is a top plan view of a continental outline map printed to scale in black ink, and comprising one of the map puzzle game components.

Referring to FIGS. 1*a* and 1*b* of the drawings, there is shown a map puzzle game kit and teaching aid in accordance with the invention. Generally stated, the map puzzle game kit comprises a clear polyethylene round tube 8, having an end cap 12. Tube 8 has a diameter of about 3 inches and a length ranging from about 23 to 35 inches. It serves as a container for the kit components, and is especially adapted for storage of the assembled map puzzle game when not in use.

Puzzle game base, shown generally at 10, is preferably formed from a spun bonded olefin sold under the Dupont trademark TYVEK®. Base 10 has a width typically ranging from about 15 to 40 inches, preferably about 20 to 35 inches. A raw, 6.4 mil #1056 or heavier spun bonded olefin has been found suitable for use as a base 10. The finished size of puzzle game base 10 typically ranges from approximately 22 in on the shorter dimension to approximately 34 in on the longer dimension, depending on the particular continent or region depicted, and the scale thereof This size permits the puzzle game base 10 to accommodate puzzle pieces such as actual size reproductions of original postage stamps, shown generally at 35 in FIG. 2*a,* and described in greater detail hereinafter. Indicia for base 10 includes a printed, accurate continental outline map 14 reproduced to scale 16 in black or other dark-colored ink. Map 14 is preferably designed in a stylized ancient cartographic format on a pastel background, preferably gold or a straw-colored yellow. When map 14 is printed on raw TYVEK®, a fiber swirl pattern inherent in the TYVEK® is visible through the ink and creates an intentional "parchment" or "rice paper" effect that is evocative of ancient maps that were printed on parchment or vellum. Additional base 10 indicia comprise a plurality of ⅜-inch circle outlines 18 (typically 25–105, varying with the number of political entities associated with a particular continent or region.) Each of the circle outlines 18 is juxtaposed with a printed number 20.

In a preferred embodiment, shown by FIG. 1*b,* label indicia on the base 10 are intentionally kept to a minimum, including only the names of the continent 22, oceans 24, and seas 26 depicted thereon. Capitals are not shown; but could be added, if desired, using a less intense marking protocol that would not unduly clutter the map or otherwise detract from stamp images on the puzzle pieces. With the exception of a few rivers and lakes 28 that form political boundaries, topographic features are preferably not shown on map 14. Printed along the perimeter of the base 10 are black or other dark-colored border indicia 30 inscribed with white or light-colored assembly instruction indicia 32. The base 10 is optionally provided at the top with at least one grommet 34, and preferably a plurality tthereof, to permit the unit to be suspended from suction hooks or pushpins on a wall, bulletin board, easel or the like.

Figure 2A:
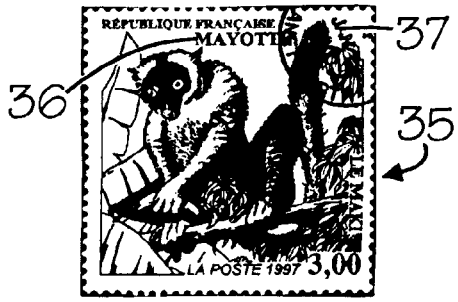
FIG. 2*a* is a pictorial view of an original cancelled postage stamp issued by an official government stamp-issuing entity.
Figure 2B:
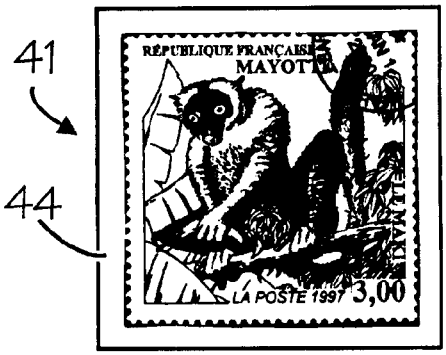
FIG. 2*b* is a pictorial view of the front side of a puzzle piece comprising an original stamp image reproduced on a plastic sheet.
Figure 2C:
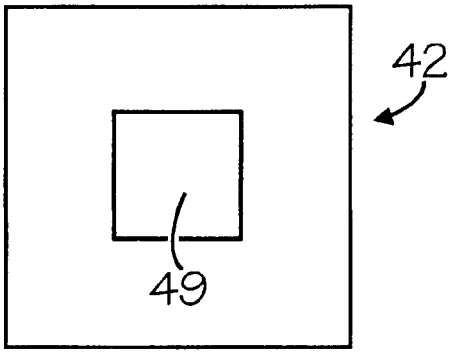
FIG. 2*c* is a plan view of the backside of a puzzle piece having a "kiss-cut" hook-only square affixed thereto.
Figure 2D:
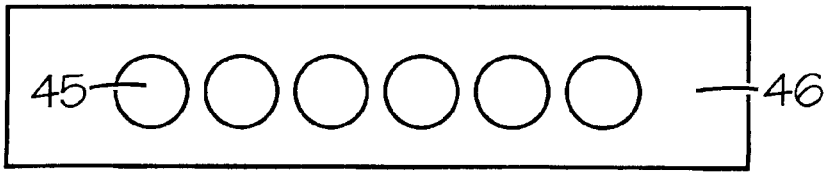
FIG. 2*d* is a plan view of a segment comprising a plurality of loop-only coins with backing, which coins are adapted to be adhered at a plurality of locations to a puzzle game base.
Figure 2E:
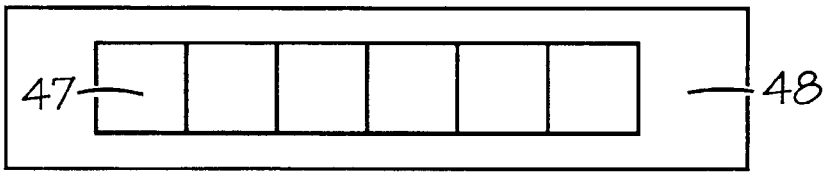
FIG. 2*e* is a plan view of a segment comprising a plurality of self-adhesive "kiss-cut" hook-only squares with backing, which squares are adapted to be adhered at the backside of map puzzle game pieces.
Figure 2F:
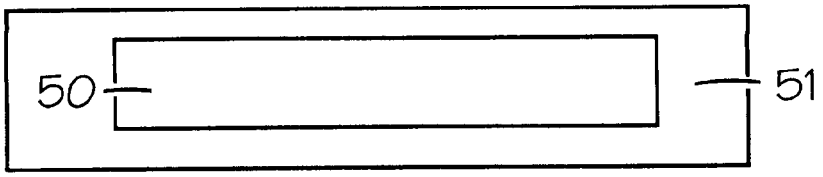
FIG. 2*f* is a plan view of a segment of self-adhesive loop tape with backing, which tape is adapted to be adhered at a plurality of borders along the periphery of a map puzzle base.
Figure 3:
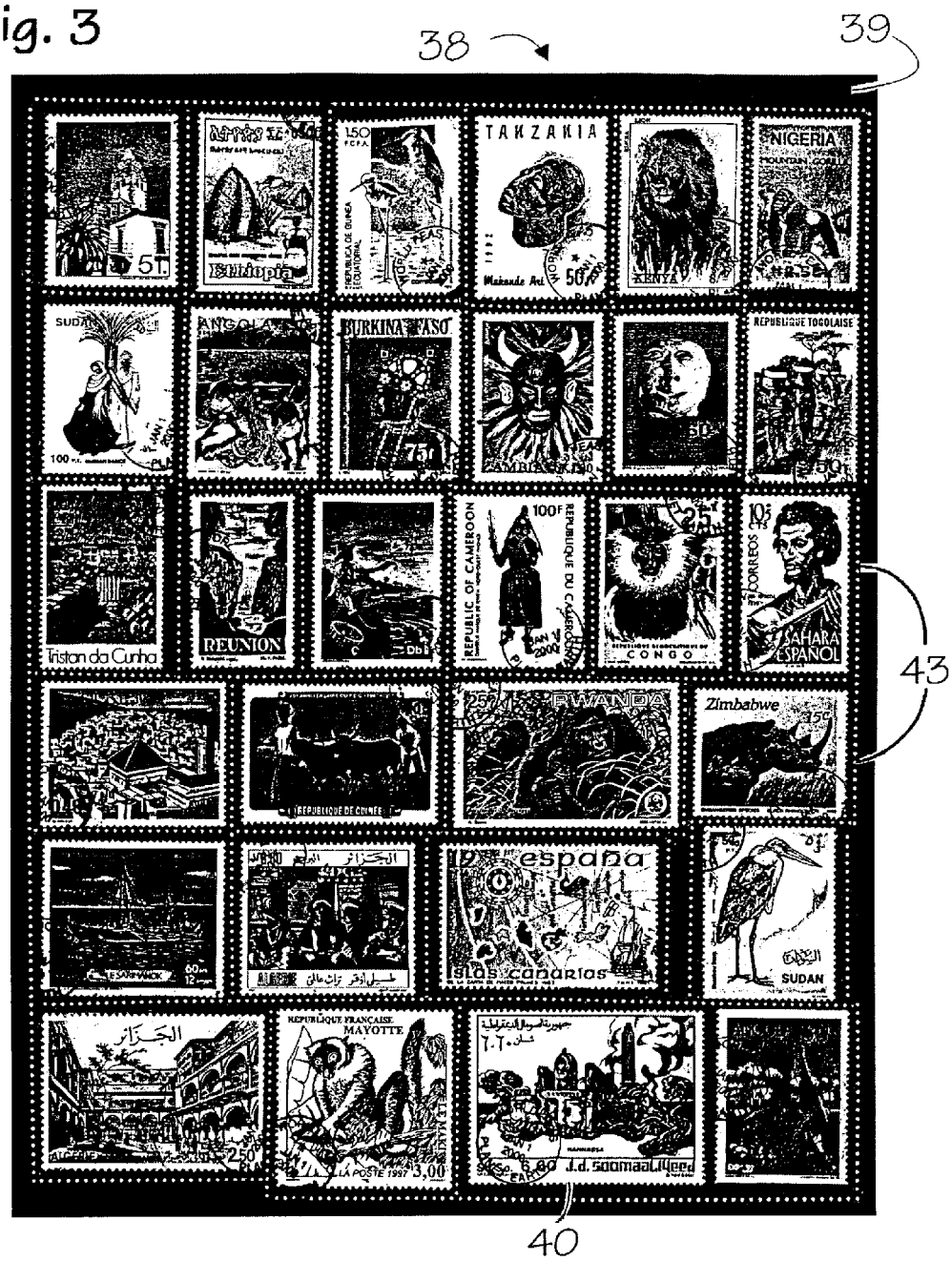
FIG. 3 is a plan view of a plastic sheet having reproduced indicia comprising a plurality of postage stamp reproductions and a cutting guide to facilitate the conversion of stamp reproductions into puzzle pieces, the plastic sheet comprising one of the map puzzle game components.

Referring to FIGS. 2*a* through 3 of the drawings, there are shown additional kit elements that pertain to the present invention. FIG. 2*a* is a pictorial view of an original postage stamp 35 issued by an official government stamp-issuing entity of the world. Each original stamp 35 is inscribed with the name 36 of the issuing political entity. All original postage stamps 35 adopted for use with the present invention are cancelled 37 to enable their full color reproduction in actual size. In the preferred embodiment, original postage stamps 35 are pre-selected for their educational value, artistry, relevance to the issuing political entity, and positive imagery. Each pre-selected postage stamp 35 depicts an image that represents a salient aspect of the people, culture, history, flora, fauna, architecture, landmarks, topography and the like, of the stamp-issuing entity with which it is associated. Each individual stamp 35 adapted for use with the present invention corresponds to a particular numbered circle location 18 on base 10 as at FIG. 1*b*.

FIG. 3 is a plan view of a sheet 38 whereon scanned images of a plurality of cancelled postage stamps issued by official government postal authorities of the world have been aligned and reproduced. In one embodiment, original postage stamps 35 are scanned at a high resolution and aligned on an 8½"×11" black background 39 or other dark-colored background, so as to offset the stamp perforations 40. The scanned stamp images 38, shown by FIG. 3, are preferably reproduced on 15–20 pt. white synthetic paper of the type known as HOP-SYN®, a clay-modified polypropylene substrate that has substantially the same feel and texture as white offset paper, and which is recyclable as a plastic. In an alternate embodiment (not shown), scanned stamp images 38, shown by FIG. 3, are reproduced on white recycled paper and laminated on both front side and back sides with clear, UV-resistant, 5-mil polyethylene or polyester laminating film.

From 1 to 4 plastic sheets 38 of reproduced postage stamp images, shown in FIG. 3, are typically included with each kit of the present invention, the number of sheets 38 varying according to the number of political entities associated with a particular continent or region. Users are directed to cut all reproduced stamps (hereinafter referred to as "puzzle pieces" 41, as at FIG. 2*b*) from the black background 39 using scissors (not provided), and by following cutting indicia 43. Referring to FIG. 2*b,* after puzzle pieces 41 have been separated from the black background 39 and trimmed, a black margin 44 of approximately 1/16th inch remains outside the "teeth", or projecting tips of the perforations 40.

Referring to FIGS. 2*d* through 2*f*, a plurality of means enable puzzle pieces 41 to be removably attached to the base 10. In the preferred embodiment, removable attachment of the puzzle pieces to the base 10 is accomplished using three forms of hook-and-loop fasteners of the type known by the trademark VELCRO®.

As shown at FIG. 2*d*, the kit of the present invention further comprises a single length of a plurality of loop-only coins 45, a segment of which is shown. Preferably, each of the coins 45 has a diameter of about 3/8 in. Generally the number of loop-only coins 45 provided with each kit of the present invention ranges from about 25 to 105, varying according to the number of political entities that are associated with a particular continent or region. The loop-only coins 45 are provided with a self-adhesive means for affixing to the base 10. Users are instructed to remove one loop-only coin 45 from backing 46, and to affix one loop-only coin 45 to map base 10 at one of the numbered circle outlines 18 shown by FIG. 1*b*. The procedure is then repeated for each of the numbered circle outlines 18 on the map base 10.

Referring to FIG. 2*e*, the kit of the present invention further comprises a single length of a plurality of hook-only "kiss-cut" squares 47, a segment of which is shown. Each of the squares 47 is preferably about 5/8 in.$^2$ Generally, the number of hook-only "kiss-cut" squares provided with each kit of the present invention ranges from about 25 to 105, varying according to the number of political entities associated with a particular continent or region. Users are directed to peel one self-adhesive hook square 47 from its backing 48, then to center and apply 49 as at FIG. 2*c* to the backside 42 of one puzzle piece. The procedure is then repeated for the backside 42 of each puzzle piece 41.

Referring to FIG. 2*f*, the kit of the present invention further comprises at least one length of black or dark-colored self-adhesive loop-only tape 50, which is adapted to be affixed along certain borders 30 as directed by indicia 32 of the base 10 as shown at FIG. 1*b*. Preferably the loop-only tape 50 has a width of about 5/8" a segment of which is shown. Generally, the length of loop-only tape provided with each kit ranges from about 1 to 4½ yards, varying according to the total linear footage of borders with indicia 32. One segment of self-adhesive loop tape 50 is peeled away from backing 51 and applied along borders of map base 10 at all positions 32 indicated by border indicia as at FIG. 1*b*.

Referring to FIGS. 4*a* through 5*b*, there is shown a plurality of companion keys and reference materials designed to enhance the learning experience of the present invention, with (i) a concise key illustrating the correct location on the map for positioning each puzzle piece, and (ii) reference material relating the significance of each stamp image reproduced on a puzzle piece to the country or other political entity it represents.

Figure 4A:
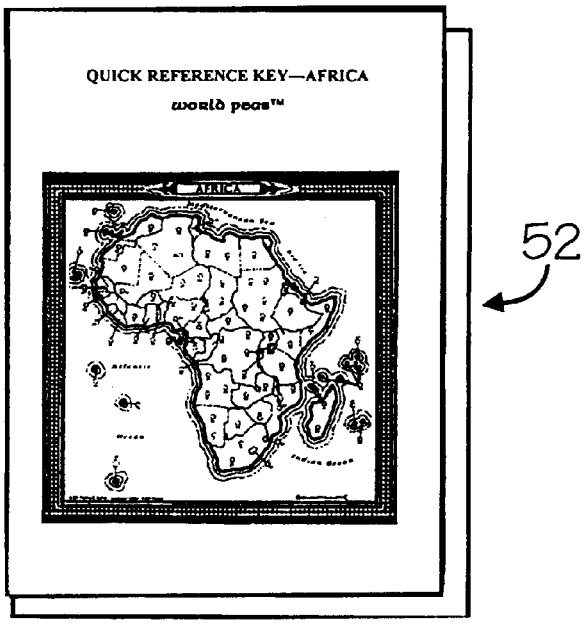
FIG. 4*a* is a perspective view of a concise "quick reference" map puzzle key.
Figure 4B:
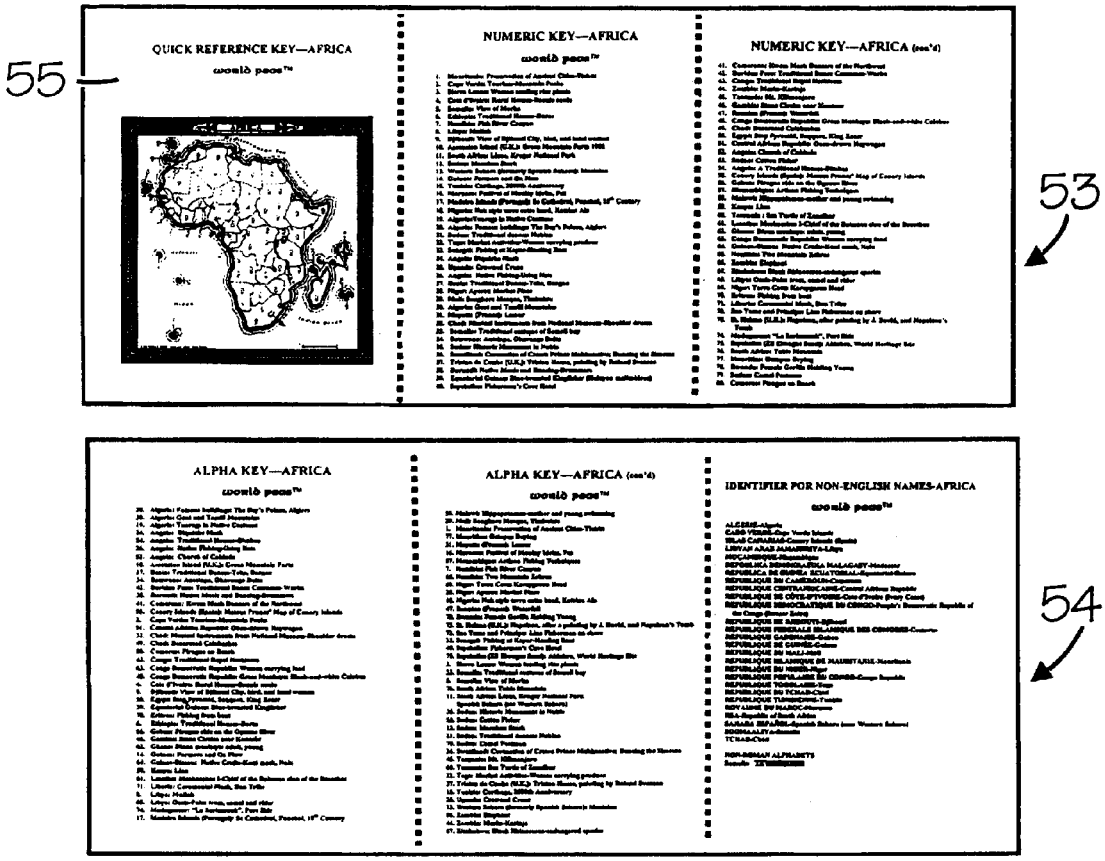
FIG. 4*b* is a top plan view of three front panels and three back panels of a "quick reference" map puzzle key.

FIG. 4*a* is a perspective view of a concise "quick reference" map puzzle key 52, one of which is included with each kit of the present invention. Quick reference key 52 is preferably printed for convenience of use in a tri-fold format, on TYVEK® or a recyclable plastic for the durability required of repeated use. Referring to FIG. 4*b*, quick reference key 52 preferably includes from three to six 8½"×11" panels of information relating puzzle pieces 41 to map base 10. The tri-fold format of key 52 is shown in detail at FIG. 4*b*, with three front panels 53 and three back panels 54. Key 52 is folded in such a way that the top facing panel, or "cover" 55 is a miniature replica of map base 10 shown at FIG. 1*b*.

Referring to FIGS. 4*c* through 4*e*, there are shown partial views of three distinct elements of quick reference key 52, including an alphabetic key 56 (hereinafter referred to as an "alpha key"), an ascending numeric key 60 (hereinafter referred to as a "numeric key"), and an identifier 64 of non-English language inscriptions and non-Roman alphabets (hereinafter referred to as an "identifier.")

Alpha key 56, shown by FIG. 4*c*, is organized alphabetically by name of the political entities 57 represented on map base 10. Each political entity name 57 is juxtaposed with a number 58 indicating the correct numbered circle position 18 of each puzzle piece 41 on the map base 10. Additionally there is included for each political entity name 57 and number 58, a one-line description 59 of the stamp image reproduced on the corresponding correct puzzle piece 41.

As shown by FIG. 4*d*, key 52 further includes a numeric key 60 organized in ascending order of the number 61 assigned to the correct numbered circle location 18 for each puzzle piece 41 on map base 10. Numeric key 60 includes political entity names 62 and a one-line description 63 of the corresponding correct puzzle piece 41.

Both alpha key 56 and numeric key 60 are used to accelerate the answer verification process. By illustration, if a player seeks to learn which particular puzzle piece 41 correctly corresponds to position "4" on map base 10, the player can readily look up number "4" on the numeric key 60 to learn from the one-line description 63 that the correct puzzle piece 41 is that of "Côte d'Ivoire", depicting rural houses. Conversely, if a player holding a particular puzzle piece 41 inscribed with "Algeria" and depicting people dressed in native costumes seeks to learn the correct location on map base 10 for the particular puzzle piece 41, the player consults alpha key 56 under "Algeria." From the one-line descriptions 59 of puzzle pieces 41, the player learns that the correct position for the "Algeria" puzzle piece 41 on map base 10 is the "#19" position.

Referring to FIG. 2*a*, all of the original postage stamps 35 adapted for use with the present invention include the issuing political entity's name 36 as part of the stamp design. In most instances, the names of political entities 36 inscribed on the original postage stamps 35 are instantly recognizable to users as cognates of the English language version of the name. There are nonetheless a few political entity names for which the English version is not readily discernable from the inscriptions on the original stamp 35 adapted for use as a puzzle piece 41. Similarly, there are a few instances in which the political entity name is inscribed on the original stamp 35 in a non-Roman alphabet. Accordingly, quick reference key 52 thus also provides at FIG. 4*e* an identifier 64 that provides an English language translation 65 of non-English political entity name inscriptions 36, and a Roman alphabet version of political entity names 36 (shown in FIG. 2*a*) inscribed using non-Roman alphabets 66.

FIG. 5*a* is a plan view of an expanded reference, generally shown at 67 and preferably printed in black-and-white, and produced in book style on TYVEK®, HOP-SYN®, or the like. Referring now to FIG. 5*b*, reference 67 is organized alphabetically by name 68 of the political entities represented by puzzle pieces 41. The number 69 assigned the puzzle piece 41 on the base 10 is indicated between parentheses immediately to the left of the political entity name 68. The SCOTT® number 70 (a registered trademark of the Scott Publishing Company) of the original postage stamp 35 reproduced on the puzzle piece 41 appears immediately following the political entity name 68. The Scott® numbering system for classifying and identifying postage stamps is the system most commonly recognized in the United States by stamp dealers and collectors. The SCOTT® number is offered, should users of the present invention wish to research or purchase any of the original postage stamps adapted for use with the present invention. Reference 67 also provides a one-line description 71 of the stamp image represented by the puzzle piece 41. To further facilitate the identification of puzzle pieces 41 and the underlying original stamps 35 therefor, gray-scale reproductions 72 are set forth, preferably at seventy percent of the stamp's original size to conserve space. Reference 67 additionally provides a short article 73 of about 100 to 200 words that relates the significance of each stamp image reproduced on a puzzle piece 41 to the political entity to which it pertains. Additional information preferably includes the name of the designer of the original stamp (if known), and miscellaneous additional historic or geographic information.

At FIG. 6 there is shown a master score sheet template 74 adapted for use with the map puzzle game of the present invention. Score sheet template 74 is preferably reproduced on 10 pt., high-gloss white synthetic paper of the type known as HOP-SYN®, a clay-modified polypropylene substrate that has substantially the same feel and texture as white offset paper, and which is recyclable as a plastic. Users may write on the original score sheet template 74 with an erasable marker of the type known as EXPO®. When multiple copies of score sheet 74 are needed simultaneously, as with teams, users are instructed to photocopy the original score sheet template 74 as required for use when scoring the game in the manner described hereinafter.

Once assembled, the map puzzle game can be played on either a vertical surface such as a wall or bulletin board, or on a horizontal planar surface such as a table. The map puzzle game can be played in a plurality of ways, using a plurality of different rules and scoring arrangements. Accordingly, it will be understood by those skilled in the art that the following rules and approaches to playing the map puzzle game are exemplary. Such rules and scoring arrangements are set forth herein for illustrative purposes. They may be altered according to special needs or desires of game participants, and should not be used to limit the scope of the present invention.

Figure 7:
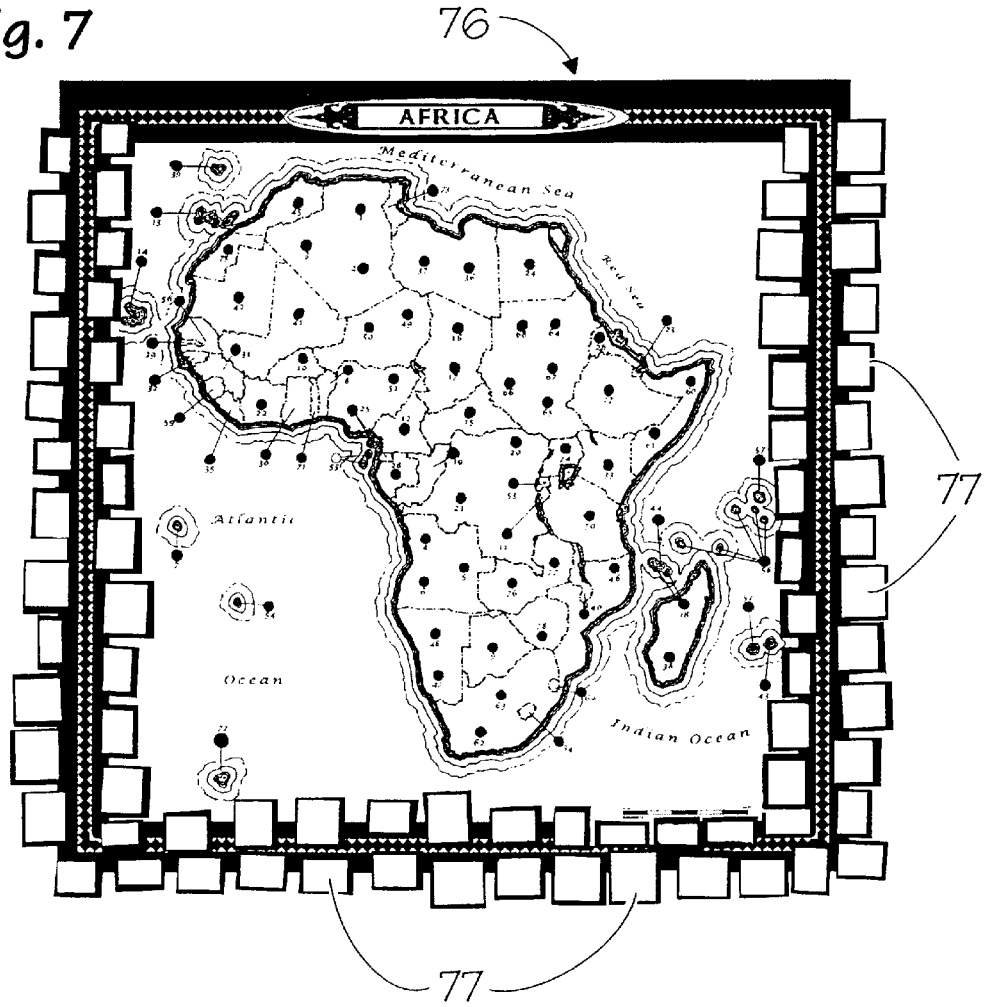
FIG. 7 is a top plan view of an assembled map puzzle base, illustrating puzzle pieces attached at borders of the map puzzle base at places where loop tape has been applied.

FIG. 7 is a top plan view of an assembled map base as it appears at the commencement of each game, shown generally at 76. The game begins with all puzzle pieces 41 adhered along the borders 77 where loop tape 50 has been applied. A non-player, or alternatively a player who is not the first player, is designated custodian of the quick reference key 52, a score sheet 74, and a timing device (not supplied), such as a stopwatch or a minute timer. The custodian sets the timer for a predetermined time period, verifies answers according to the quick reference key 52, and records scores on score sheet 74.

Figure 8:
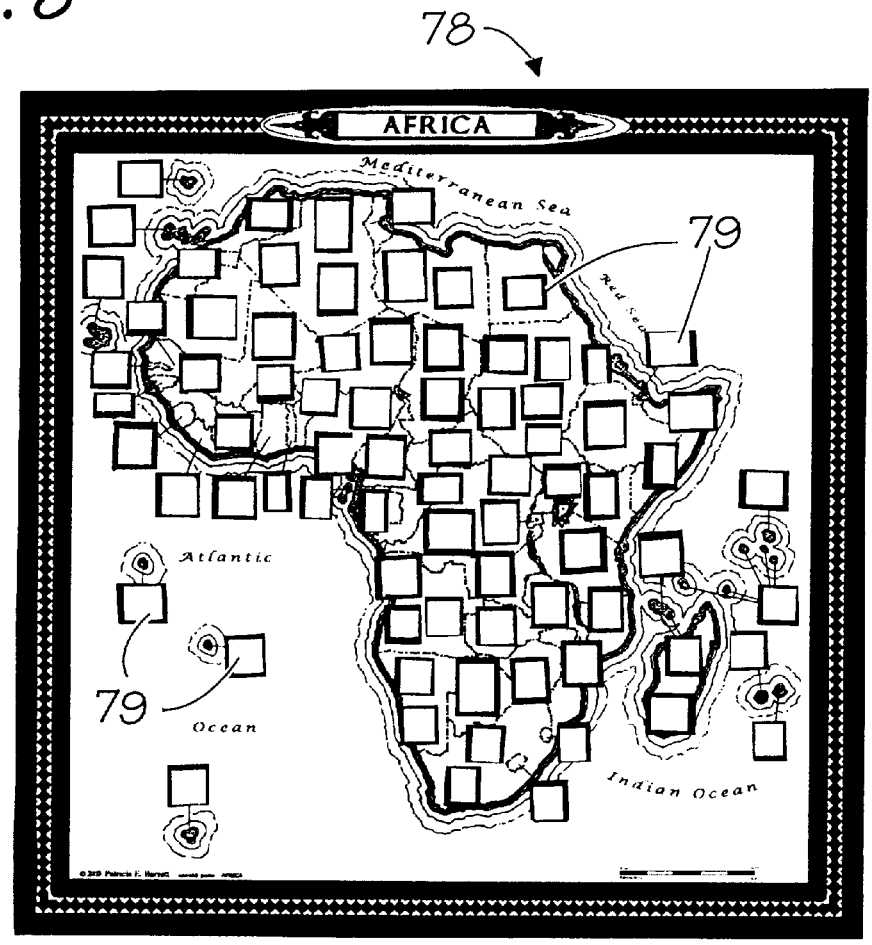
FIG. 8 is a top plan view of an assembled map puzzle base, illustrating puzzle pieces attached at correct locations on the map puzzle base, and further illustrating an alternate embodiment in which the map base is adapted for use in displaying stamps and coins by world topical stamp and world coin exhibitors or collectors.

The first player, or team comprising a plurality of players, preferably ranging from 2 to 10, (hereinafter "player #1") randomly chooses a single puzzle piece 41 (hereinafter "puzzle piece #1") from among those adhered along the borders 77 of map base 76, shown in FIG. 7. Referring now to FIG. 8, player #1 is given three tries to correctly match puzzle piece #1 with the correct map site 79 within the predetermined time period. Three points are scored for a correct answer on the first try; two points for a correct answer on the second try, and one point for a correct answer on the third try. If player #1 correctly matches puzzle piece #1 with the correct map site 79 within the predetermined time period, play continues, with player #1 choosing a second puzzle piece 41 from the borders 77 of map base 76, shown in FIG. 7, and the above-described procedure is repeated.

If player #1 fails, after three tries, to place puzzle piece #1 at its correct map site 79, shown in FIG. 8, within the predetermined time, player #I replaces puzzle piece #1 on the border 77 of map base 76, as shown in FIG. 7. If there is no permanently designated custodian of the quick reference key 52, score sheet 74, and timing device, player #1 takes custody of those items. A second player or team (hereinafter "player #2") then takes a turn, choosing a single puzzle piece 41 from borders 77 of map base 76, and attempting to match puzzle piece 41 with the correct map site 79, shown by FIG. 8, within the predetermined time period.

If a scorekeeper/timekeeper has not been permanently designated, player #2, having noted the correct position of puzzle piece #1 from the quick reference key 52 during player #1's unsuccessful try, should immediately be able to earn three points for choosing and correctly positioning the same puzzle piece. At the end of a predetermined number of turns, or when all of the puzzle pieces 41 have placed in the correct positions 79 on map base 78 as shown at FIG. 8, the player or team with the highest number of points is declared the winner. It will be noted as at FIG. 6 that the maximum possible score 75 is inscribed near the top of score sheet template 74. The maximum score 75 varies with the total number of puzzle pieces supplied with each continental or regional map puzzle kit of the present invention, typically ranging from approximately 60 to 300 points, after total number of puzzle pieces is multiplied by a factor of three.

Generally, a single puzzle piece 41 is provided for each political entity. For some of the larger political entities, however, a plurality of puzzle pieces is preferably provided for the sake of symmetry and other considerations. In such instances, each of said multiple puzzle pieces 41 corresponds to a specific position 79 within its political entity that approximates the location or region where the subject matter depicted on the puzzle piece 41 is typically found in practice. Additionally, in many instances, the space allocated for a particular puzzle piece 41 has minimal tolerance dimensions, requiring rather precise placement of the puzzle pieces 41 on the map puzzle base 78, shown in FIG. 8. As puzzle pieces 41 generally tend to vary significantly in size and orientation, players are exhorted to adhere literally to the positions 79 specified for each puzzle piece 41 on the quick reference key 52. In one embodiment, players locating a puzzle piece within the borders of the correct political entity within the predetermined time limit are credited with a correct answer regardless of the positioning specified on key 52. In those circumstances, the custodian of key 52 should move the puzzle piece 41 to its correct location 79 as specified on key 52 so that players may observe and gradually internalize the more accurate positioning for all puzzle pieces 41.

Inasmuch as game participants may find the map puzzle game initially difficult to play, it is recommended that, before attempting to play the game for the first time, players spend time familiarizing themselves with each puzzle piece 41, in consultation with quick reference key 52 and expanded reference 67. At least once before attempting to play the map puzzle game of the present invention, it is suggested that all puzzle pieces 41 be placed at their correct positions 79, shown by FIG. 8. Most individuals will find the puzzle game relatively easy to master if a concerted effort is made each time the game is played to observe the correct position 79, shown in FIG. 8, for each of the puzzle pieces 41.

In use of the map puzzle game as a classroom teaching aid, map sets from several different continents and regions can be rotated among a plurality of teams. Each team attempts to achieve the highest score in the shortest time period for each of the various continental and regional maps.

The map puzzle game described herein can be modified in numerous ways without departing from the scope of the invention. In an alternate embodiment, the map puzzle game base may be folded and stored in a heavy-gauge, clear polypropylene zippered or zip-lock bag, fitted with three holes along the left margin, so as to enable the assembled map base and puzzle pieces to be stored in a three-ring binder. In other embodiments, the map puzzle base can be mounted on foam board and framed.

Alternate embodiments involving puzzle pieces of the present invention include the embedding in the puzzle pieces of a melody or audio chip of a conventional type, such as that typically used with musical paper greeting cards. This audio chip could be incorporated to play a political entity's national anthem, popular song, or some genre of music that is played locally.

Although the present invention is based upon original postage stamps issued by official government postal authorities of the world, another modification could comprise puzzle pieces made from simulated "postage stamps" crafted from sheets of miniaturized photographs superimposed with political entity name graphics, and perforated in the manner of authentic postage stamps. Such substitutions might be necessary to represent, for example, a political entity such as the territory of Western Sahara, a former Spanish protectorate in northwest Africa that has been occupied by Morocco since 1976. Although there was a UN-sponsored referendum in 1988 offering the people of Western Sahara (the Saharawi) a choice between independence and integration with Morocco, the UN's attempts to organize such a referendum have been repeatedly thwarted. Although stamps inscribed with the name "Sahara Español" (Spanish Sahara) are extant, such stamps do not accurately convey the political reality of Western Sahara, and in twenty-four years, Morocco has never issued a stamp that represents Western Sahara. In such an instance, a simulated postage stamp could be fashioned from a miniaturized photograph of an image that is authentic to the Saharawi culture and inscribed with the name "Western Sahara" as it is officially known, so that the territory may become known to users of the map puzzle game of the present invention.

Simulated postage stamps or miniaturized photographs may similarly be substituted as game pieces, should the increasing proliferation of electronic postage and electronic mail transmission result in the gradual elimination of conventional postage stamps. Such reproductions of simulated postage stamps and miniaturized photographs (with a maximum size of 5 cm×7 cm) are within the scope of the present invention, as defined by the subjoined claims.

Yet another example of modifying the map puzzle game without departing from the scope of the invention involves the production of map puzzle game components, including the map base, puzzle pieces, quick reference key, expanded reference, and score sheet. These components can be produced in electronic formats such as CD-ROM, and delivered to end-users via server-based networks such as intranets and the Internet.

The map puzzle game base described herein can alternatively be used as a display apparatus for world topical stamp and world coin exhibitors or collectors. In this embodiment 78, illustrated by FIG. 8, stamp exhibitors select, reproduce, laminate and display worldwide stamps from their proprietary collections by placing them on assembled map base 78 at locations 79. Similarly, coin collectors can affix hook attachment members directly to coins of the world and display the coins on the map base 78 at locations 79.

Having thus described the invention in rather full detail, it will be understood that such detail need not be strictly adhered to, but that further changes and modifications may suggest themselves to one skilled in the art falling within the s cope of the present invention as defined by the subjoined claims.

What is claimed is:

1. A map puzzle game, comprising:

(a) a puzzle game base including a lightweight, durable, flexible, material, (b) said puzzle game base having indicia on a front surface thereof, comprising:

(i) a world continental or world regional outline map;

(ii) border indicia; and (iii) outline map indicia circumscribing a plurality of numbered location marker indicia;

(c) a plurality of playing pieces having a front face comprising reproductions of postage stamp indicia present on front surfaces of official postage stamps, said postage stamp indicia being related to said puzzle game base indicia;

(d) attachment means for removably attaching said playing pieces to said base, said attachment means comprising a two-part, self-adhesive hook-and-loop fastener system including a hook member that attaches to a back face of each of said playing pieces, and a loop member that attaches to said base at each of said marker indicia and said numbered location marker indicia;

(e) a map puzzle key comprising:

(i) miniature replica of all base indicia;

(ii) an alphabetical list of all political entities represented on said base indicia;

(iii) each of said political entity names being juxtaposed with a number indicating the correct position of each of said game pieces on said base;

(iv) each of said numbers juxtaposed with a one-line description of the corresponding correct stamp image; and (v) an ascending numeric list of each of said political entity names, juxtaposed with the same indicia as in "(f) (ii), (iii), and (iv)";

(f) an expanded reference that relates the stamp image for each playing piece to the political entity it represents.

2. A map puzzle game as recited by claim 1, wherein said game base material is a recyclable plastic.

3. A map puzzle game as recited by claim 2, wherein said game base material has a substantially planar geometry.

4. A map puzzle game as recited by claim 2, wherein said game base is adapted to be easily cleaned, rolled and stored.

5. A map puzzle game as recited by claim 1, wherein said reproductions of postage stamp indicia have a size ranging from about 50 to 120% of actual size.

6. A map puzzle game as recited by claim 1, wherein said reproductions of postage stamp indicia are color reproductions replicating actual stamp colors.

7. A map puzzle game as recited by claim 1, wherein said reproductions of postage stamp indicia depict cancelled postage stamps.

8. A map puzzle game as recited by claim 1, wherein said reproductions of postage stamp indicia depict United States and foreign postage stamps.

9. A map puzzle game as recited by claim 1, wherein said reproductions depict simulated United States and foreign postage stamp indicia.

10. A map puzzle game as recited by claim 1, wherein said playing pieces comprise a heavy-gauge, recyclable plastic on which said postage stamps are reproduced.

11. A map puzzle game as recited by claim 1, wherein said playing pieces comprise a segment of paper having front and back faces laminated with clear polymer film.

12. A map puzzle game as recited by claim 1, wherein said marker indicia and said numbered location marker indicia have pre-selected locations on said puzzle game base.

13. A method of playing map puzzle game, comprising the steps of:

(a) arranging on a game base a plurality of game pieces having the form of postage stamp reproductions, said game pieces being positioned along at least one border of said game base;

(b) randomly selecting a single game piece from said plurality of game pieces and attempting to correctly match said game piece with indicia on a front surface of said game base; and (c) noting the time period required for carrying out step "(b)" and determining whether step "(b) produced a correct match within a predetermined time period.

14. A method of playing a map puzzle game as recited by claim 13, wherein step "(b)" is carried out by a first player during a first turn, said indicia include a world continental or world regional outline map and outline map indicia circumscribing a plurality of numbered location marker indicia on said map, and said method further comprises the step of continuing said first turn if said first player creates a correct match within said predetermined time period.

15. A method for playing a map puzzle game as recited by claim 14, wherein each player is permitted three tries to select a game piece and correctly match it with said indicia, and said method further comprises the steps of:

(a) scoring three points for a correct answer on the first try;

(b) scoring two points for a correct answer on the second try; and (c) scoring one point for a correct answer on the third try.

16. A method for playing a map puzzle game as recited by claim 15, wherein said scoring steps are carried out by a custodian using a timing device and an answer key.

17. A method for playing a map puzzle game as recited by claim 16, wherein said custodian is a player that is not the first player.

18. A method for playing a map puzzle game as recited by claim 15, wherein each of said three tries does not create a correct match, said first player's turn is thereby concluded, said randomly selected game piece is repositioned along said border, and a second player is accorded a turn, during which said second player carries out step "(a)".

19. A method for playing a map puzzle game as recited by claim 18, wherein said first player becomes the custodian.

20. A method for playing a map puzzle game as recited by claim 19, further comprising the steps of repeating steps "(b)" and "(c)" until each of said game pieces has been correctly matched with indicia on said puzzle game base.

21. A method for playing a map puzzle game as recited by claim 20, further comprising the steps of:

(a) recording points scored on a score sheet; and (b) tallying points scored by each player.

22. A method for playing a map puzzle game as recited by claim 21, wherein the player having the highest number of points is declared the winner.

23. A method for playing a map puzzle game as recited by claim 19, further comprising the steps of:

(a) allotting a pre-selected period of time for playing said map puzzle game;

(b) repeating steps "(b)" and "(c)" for said pre-selected period of time;

(c) recording points scored on a score sheet;

(d) tallying points scored by each player;

(e) declaring as winner the player having the highest number of points.

24. A method for playing a map puzzle game as recited by claim 13, wherein said game has a plurality of game participants.

25. A method for playing a map puzzle game as recited by claim 24, wherein said game participants are selected from the group consisting of players, teams and mixtures thereof.

26. A method for playing a map puzzle game as recited by claim 13, wherein the number of said participants ranges from 2 to 50.

27. A method for playing a map puzzle game as recited by claim 23, wherein said game includes a plurality of map puzzle bases, and further comprises the steps of:

(a) rotating said map puzzle bases among a plurality of teams;

(b) repeating steps "(i)" to "(n)" for each rotation of said map puzzle bases;

(c) declaring as winner the team having the cumulative score based on all rotations of said map puzzle bases.

28. A method for playing a map puzzle game as recited by claim 13, wherein each of said postage stamp reproductions includes a characteristic of a stamp-issuing entity corresponding to one of said indicia on said front surface of said game base.

29. A method for playing a map puzzle game as recited by claim 28, wherein said characteristic is selected from the group consisting of an indigenous people, culture, religion, history, flora, fauna, architecture, landmark, topography, and mixtures thereof.

30. A map puzzle game as recited by claim 1, having an electronic format.

* * * * *